United States Patent [19]

Hopler, Jr.

[11] 4,073,235

[45] Feb. 14, 1978

[54] EXPLOSIVE ENERGY-INITIATABLE BLASTING CAPS CONTAINING A POROUS IGNITION AND DETONATION SYSTEM AND METHOD

[75] Inventor: Robert Bartley Hopler, Jr., Succasunna, N.J.

[73] Assignee: Hercules Incorporated, Wilmington, Del.

[21] Appl. No.: 710,059

[22] Filed: July 30, 1976

[51] Int. Cl.[2] ..... F42D 1/04; F42B 3/10

[52] U.S. Cl. ..... 102/22; 102/23; 102/29

[58] Field of Search ..... 102/22, 23, 27–29

[56] References Cited

U.S. PATENT DOCUMENTS

| | | | |
|---|---|---|---|
| 3,132,585 | 5/1964 | Higashishima et al. | 102/28 R |
| 3,885,499 | 5/1975 | Hurley | 102/29 |
| 3,939,772 | 2/1976 | Zebree | 102/29 |

*Primary Examiner*—Verlin R. Pendegrass
*Attorney, Agent, or Firm*—Joshua W. Martin, III

[57] ABSTRACT

A non-electrically initiated blasting cap containing a porous ignition charge which is permeable for flow of a gas stream therethrough and initiatable in response to explosive energy of an explosive gas mixture, including conduit means for emplacing a confined stream of the explosive gas in position within the blasting cap for the responsive initiation.

Also provided is a system, including a plurality of the above blasting caps spaced apart for detonation of one or more main charges, together with additional conduit means for conveying the explosive gas to the plurality of blasting caps for the emplacement, and means for ignition of the thus emplaced explosive gas.

Method is provided for making a blasting cap containing a porous ignition charge, making a porous ignition charge and initiating a non-electric blasting cap for the initiation of a main explosive charge.

19 Claims, 6 Drawing Figures

EXPLOSIVE ENERGY-INITIATABLE BLASTING CAPS CONTAINING A POROUS IGNITION AND DETONATION SYSTEM AND METHOD

This invention relates to non-electric blasting caps initiated by the heat produced by the ignition of an explosive gas mixture. In one aspect, this invention relates to non-electric blasting caps containing a porous ignition charge, initiatable in response to action of explosive energy of an explosive gas mixture together with conduit means in contact with the porous ignition charge for employing a confined stream of the explosive gas in ignition position within the blasting cap for the responsive initiation. A further aspect of this invention relates to a detonator system, including a plurality of blasting caps above described, together with means for emplacing an explosive gas mixture in ignition relationship with a responsively initiatable ignition charge(s) for the detonation of one or more main charges. A still further object of this invention relates to methods for making a porous ignition charge, making a non-electrically initiated blasting cap and initiating a non-electrically initiated blasting cap for the initiation of a main charge. Other aspects will be apparent in light of the accompanying disclosure and the appended claims.

BACKGROUND OF THE INVENTION

Non-electric blasting caps initiatable by explosive energy from the detonation of an explosive gas mixture are disclosed and claimed in U.S. Pat. No. 3,885,499 to Hurley. These blasting caps contain an open space adjacent the ignition charge, a first conduit extending from outside the blasting cap into the open space in open communication with the ignition charge so as to convey the explosive gas as a confined stream into the open space for responsive ignition of the ignition charge; and a second conduit extending from the open space to the outside of the shell so that a stream of the explosive gas mixture can be continuously passed from the first conduit through the open space and through the second conduit to purge and charge the system for the detonation and responsive ignition of the ignition charge.

In the embodiments illustrated in the above patent, the cap shell is elongated and closed, including at one end a plug type closure member spaced from the ignition charge to form the requisite open space. Both conduits are plastic and thin walled for flexibility purposes. The first conduit extends into the shell through the end closure member and the second conduit extends from the open space either through the plug end closure or through the side of the cap shell.

SUMMARY OF THE INVENTION

This invention is concerned with non-electric blasting caps essentially of the type above described but which do not require an open space between the ignition charge and the plug closure member.

In accordance with the invention, a non-electrically initiated blasting cap is provided which comprises: a closed shell, including a plug closure therefor; an ignition charge in said shell substantially contiguous with said plug closure and initiatable in response to action of explosive energy of an explosive gas mixture, and sufficiently porous and permeable for flow of a gas stream through the interstices thereof; a first conduit means extending from outside said shell through said plug closure and opening into contiguous contact with said ignition charge so as to convey an explosive gas mixture as a confined stream into initiating position in said interstices for responsive initiation of said ignition charge; and a second conduit means extending from continuous contact with said ignition charge to the outside of said shell, whereby a stream of said explosive gas can be continuously passed from said first conduit means through the interstices of said ignition charge and through said second conduit means to purge and charge said porous ignition charge and thereafter explosive gas in said first conduit means can be ignited for preparation of resulting explosive energy within the interstices of said porous ignition charge for initiation of same.

In a preferred embodiment, the closed shell is elongated, having a base charge in the integrally closed end of the shell, a primer charge in direct operative communication with the base charge, a porous ignition charge in operative contact with the primer charge, with or without a delay charge intermediate the primer and ignition charges, wherein the plug closure substantially fills the cross-section of the shell and has a first and a second passageway therethrough to allow gas to be introduced into and to exit from the closed shell. Further, and in preferred practice, the porous ignition charge alone or together with a delay charge substantially fills the cross-section of the closed shell between the primer charge and the plug closure, has interconnected pores and is initiatable in response to action of explosive energy of an explosive gas mixture, wherein, in turn, the primer charge is detonatable in operative response to the heat produced by the ignition charge or the ignition charge and delay charge, and the base charge is detonatable in response to the detonation of the primer charge, and wherein a delay charge might be included intermediate to the primer and ignition charges, said delay charge would be detonatable in operative response to the heat produced by the ignition charge.

Further, in accordance with the invention, a detonator system is provided for detonation of one or more main charges comprising a plurality of spaced apart non-electrically initiated blasting caps above described, wherein the first passageway of the first of said plurality is connected with a source of explosive gas mixture and means for igniting said explosive gas mixture, and the second passageway of the first of said plurality is connected with the first passageway of the second of said plurality and thereby in series to provide for purging and charging action of the porous ignition charge in each of said blasting caps by flow of the explosive gas mixture in series flow therethrough and subsequently for ignition of said explosive gas mixture to propagate an explosive reaction front in series through each of said blasting caps in said plurality. In addition, the invention includes a method for making a porous ignition charge, a method for making a blasting cap containing a porous ignition charge, and a method for initiating a non-electric blasting cap for the initiation of a main explosive charge.

BRIEF DESCRIPTION OF THE DRAWINGS

The invention is illustrated with reference to the drawings of which:

FIGS. 4–6 are particularly illustrative of the method for initiating non-electric blasting caps for the initiation of main explosive charges.

DESCRIPTION OF THE PREFERRED EMBODIMENTS

Figure 1:
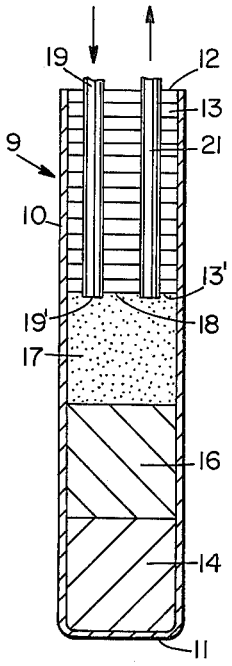
FIG. 1 illustrates a zero delay type blasting cap of the invention, including a pair of conduits supported in an ignition plug end closure for ingress and egress of the explosive gas mixture during the purging and charging operation, and thereafter for ingress and explosive energy from ignition of the explosive gas mixture.

Referring to FIG. 1, elongated cup-shaped shell 10 of zero delay type blasting cap 9 is integrally closed at bottom end 11 and is closed at the opposite end 12 by ignition plug end closure 13. Base explosive charge 14, primer charge 16 and porous ignition charge 17 extend in that order in shell 10 from bottom end 11 toward closure plug 13, and face 18 of porous ignition charge 17 is in substantial contiguous contact with face 13' of plug 13. Although charge 17 can be referred to as an initiator or ignition charge, hereinafter, it will be described as porous ignition charge 17.

A first tube 19 extends from outside shell 10 through plug closure 13 into communication with porous ignition charge 17. A second tube 21 extends through plug 13 from a point in communication with porous ignition charge 17 to a point outside shell 10.

Base charge 14 is detonatable in response to detonation of primer charge 16 and primer charge 16 is detonatable in response to the heat output of porous ignition charge 17. Base charge 14 is any suitable high explosive charge such as PETN, RDX, Tetryl, or the like, with adequate explosive energy output to produce detonation of a main explosive charge in detonating relationship therewith. Exemplary of primer charge 16 is diazodinitrophenol, often a diazodinitrophenol system of the well known type including a top layer for ignition in response to ignition of the porous ignition charge 17 and an underlying higher-density layer detonatable in response to ignition of the top layer. Further exemplary primer charges 16 are diazodinitrophenol/potassium chlorate, lead azide, mercury fulminate, lead styphnate, barium styphnate, potassium dinitrobenzfuroxyl and mannitol hexanitrate tetracene.

Porous ignition charge 17 may be a porous agglomeration of particles made from an ignition powder; a permeable mat-like pad of fibrous particles of ignition material; a pellet of minute spheres of ignition material, attached to one another at their contact surfaces to prevent transport of the spheres into the gas conduits during charging or handling; or a sponge-like pellet of ignition material, with connected porosity to produce permeability. Porous ignition charge 17 must be permeable for flow of a gas stream therethrough, and initiatable in response to action of explosive energy of an explosive gas mixture. Examples of materials which can be used for porous ignition charge 17 are lead/selenium, lead-tin/selenium, tin/selenium, red lead/boron, lead monoxide/boron, lead oxide/manganese, lead monoxide/silicon, and lead/tellurium.

By the term "explosive energy" is meant the heat and flame produced by the detonation or deflagration of an explosive gas mixture.

Tube 19 is generally a plastic tube, as for example, 0.103 inch OD by 0.060 inch ID and formed from polyethylene; and confines a stream of the explosive gas mixture for flow into porous ignition charge 17, and tube 21 is the same, or similar in design and composition to tube 19. Tube 21, in direct contact with porous ignition charge 17, serves to convey a stream of explosive gas mixture from porous ignition charge 17, during the purging and charging operation and, as an element of the initiation system of the invention, to direct propagating explosive energy to the succeeding blasting cap in the system.

In the operation of blasting cap assembly 9, a stream of an explosive gas mixture such as a mixture of oxygen with a fuel such as manufactured gas, acetylene, hydrogen, or hydrogen/methane, is passed through tube 19 into porous ignition charge 17 and is thus emplaced so that, upon ignition, the resulting explosive energy propagates into initiation relationship with porous ignition charge 17. Prior to initiation of porous ignition charge 17, enough of the gas, which is initially present in the interconnected pores of charge 17, must be replaced by the explosive gas mixture from tube 19 to insure reliable initiation. This is accomplished by passing a stream of the explosive gas through tube 19, porous ignition charge 17 and then tube 21 to purge the pores of charge 17 free from such initially present gas.

Figure 2:
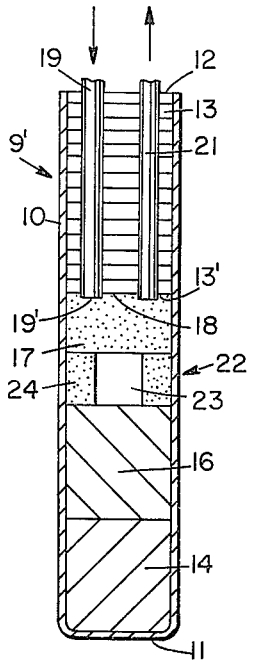
FIG. 2 is a delay type blasting cap otherwise the same as that of FIG. 1.

FIG. 2 illustrates another embodiment, which is the same as that of FIG. 1 except that the blasting cap 9' is of the delay type and contains a delay charge 22 intermediate the porous ignition charge 17 and the primer charge 16. Often porous ignition charge 17 of FIG. 2 differs in composition from that of FIG. 1 to the extent necessary to assure a sufficiently hot ignition for delay fuse 23, which is conventionally disposed as a core in a swaged metal tube 24 in ignitable relationship with porous ignition charge 17 and in detonating relationship with primer 16. Often, in a delay cap system such as that of FIG. 2, a wafer type charge (not specifically shown) which has a higher heat of reaction than that of porous ignition charge 17 and serves as a supplemental source of heat for ignition of the delay fuse, is positioned subjacent porous ignition charge 17. Such wafer type charges are generally utilized in combination with longer burning and hence less ignition-sensitive delay charges, as disclosed in U.S. Pat. No. 3,776,135.

Figure 3:
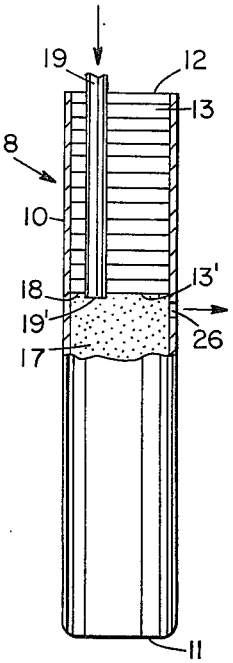
FIG. 3 is the same as FIGS. 1 or 2 except that in lieu of the egress conduit, an open passageway is disposed in the side wall of the shell for egress of the explosive gas mixture during the purging and charging operation.

FIG. 3 illustrates a blasting cap 8 which is similar to the blasting caps of FIGS. 1 and 2 except that in lieu of the tube 21, a conduit or passageway 26, extends from open communication with porous ignition charge 17 through a side wall of shell 10.

Figure 4:
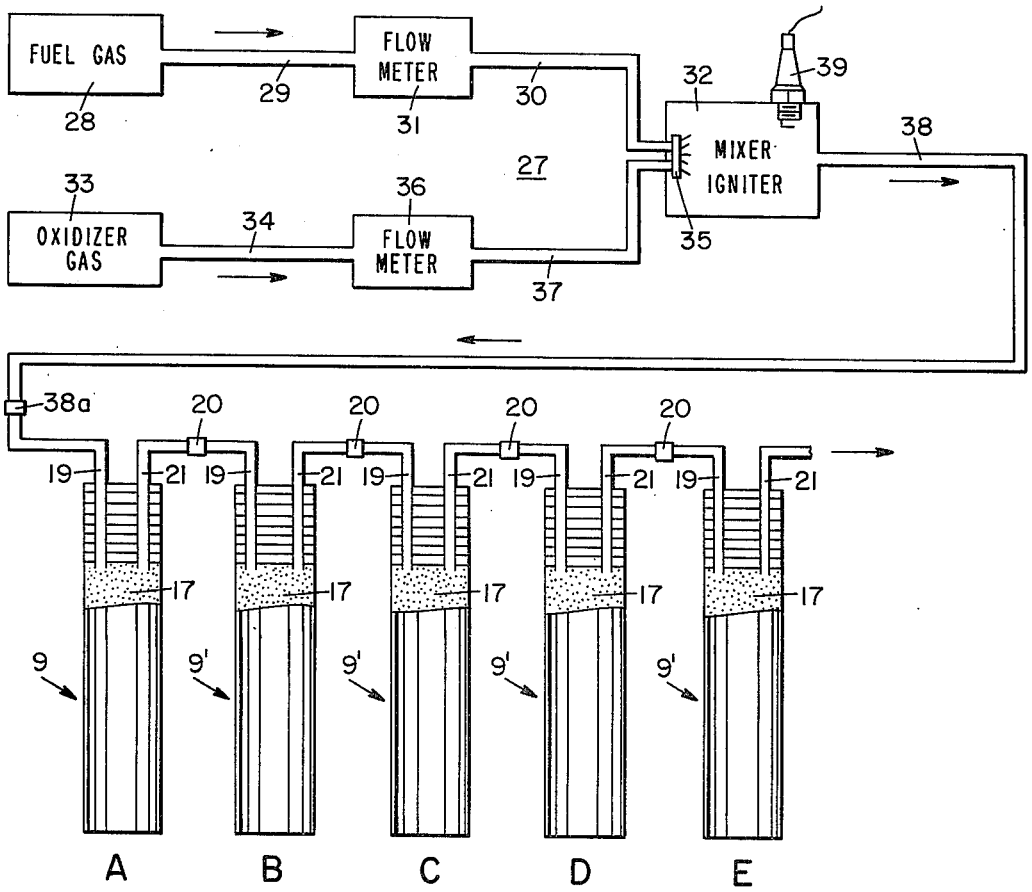
FIG. 4 illustrates a plurality of any of the blasting caps of FIGS. 1 and 2 as elements of a detonator system of the invention.

Referring to FIG. 4, a series of five blasting caps A–E inclusive, which can be any of blasting caps 9 and 9' of FIGS. 1 and 2, each for being disposed in detonating relationship with a booster or main explosive charge (neither shown), are in series with the discharge line from a gas mixing and ignition system 27. Gas mixing and ignition system 27 comprises fuel gas supply 28, connecting through line 29, gas flow control meter 31, and line 30, with gas mixing/ignition chamber 32 and oxidizer gas supply 33, connecting through line 34, flow control meter 36, and line 37 with gas mixing/ignition chamber 32.

In operation of the system 27, a suitable fuel gas, generally a manufactured gas, or a mixture of hydrogen and methane, is passed from supply 28 via line 29, through flow meter 31 which in turn controls the requisite rate of flow and pressure of fuel gas through line 30 to mixing chamber 32 for mixing therein with oxidizer gas from supply 33. Similarly the oxidizing gas is passed from supply 33 via line 34, through flow meter 36 which in turn controls the requisite rate of flow and pressure of oxidizer gas through line 37 in the required proportions for the mixing step in chamber 32. The relative proportions of fuel and oxidizer are predetermined to provide an explosive gas mixture which is then ignited in chamber 32 by a spark generated by action of spark plug 39 operatively extending into chamber 32 for that purpose.

Conduit 38 extends from chamber 32 and connects through a suitable collar, or sleeve-type connector 38*a* with inlet tube 19 of a first blasting cap 9 of the series A–E to convey flow of the explosive gas mixture from chamber 32 through the tube member 19, porous ignition charge 17 and exit flow tube 21, and in series through each of the successive caps B–E to thereby purge each porous ignition charge 17 of substantially all gas other than that from line 38 and in turn to charge each porous ignition charge 17 with the explosive gas mixture. Tube 21 of each of blasting caps 4A–D connects with tube 19 of the succeeding blasting cap of the Series B–E by any suitable means, such as by a plastic collar, or sleeve, connector 20.

During the purging and charging operation, the stream of explosive gas mixture from line 38 is passed in series through tube 19, porous ignition charge 17 and tube 21 of each of caps A–E; and the flow of explosive gas through the series A–E is maintained for a time duration sufficient to complete the requisite purging and charging of all blasting cap ignition charges 17, generally for a period of at least about one minute, but often from five to ten minutes, depending upon the flow variables involved.

Upon completion of the purging and charging action and with the flow of the explosive gas mixture in line 38 stopped, the ignitor member 39 is actuated, and, by action of the spark, the explosive gas mixture thus emplaced for ignition and responsive initiation of the porous ignition charge, is ignited. Check valve system 35 in chamber 32 precludes back pressure flow of explosive energy into the upstream flow and supply stream. The explosive reaction wave front then travels, confined in line 38 and each of the tubes 19 and 21, through each porous ignition charge 17 in series A–E.

Occasionally, one or more of the tubes 19 and 21 may fail to confine the explosive energy, in which event the reaction rate of the particular explosive gas is sufficiently high to permit the explosive reaction wave front to travel ahead of the tube breakage so that the latter does not preclude series travel of the wave front through the series of caps.

Figure 5:
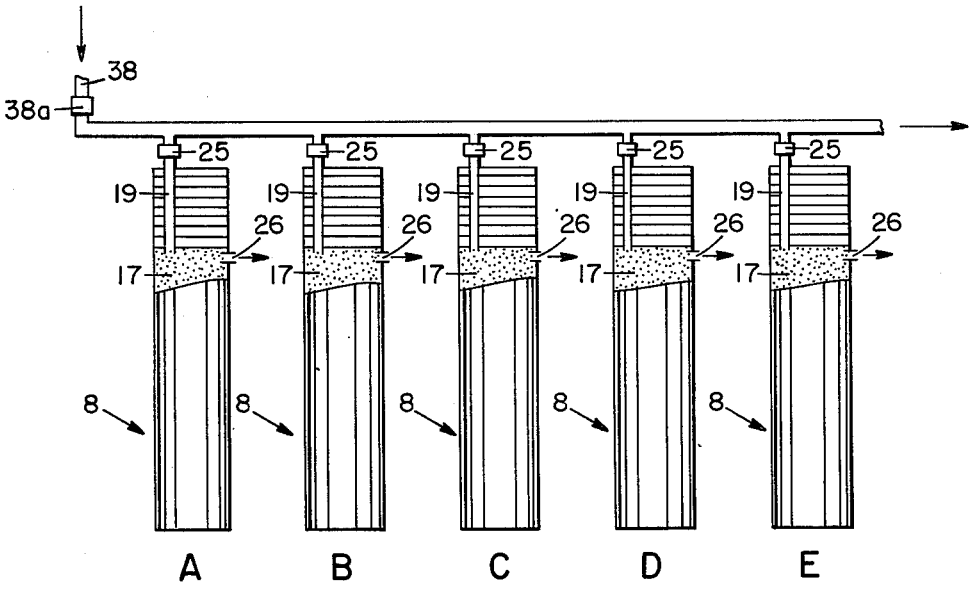
FIG. 5 is the same as FIG. 4 except that it illustrates a plurality of blasting caps of FIG. 3.

FIG. 5 illustrates another embodiment of the detonator system of the invention which is the same as that in FIG. 4 except that blasting caps 8 of FIG. 3 are in lieu of those of FIGS. 1 or 2. In the embodiment of FIG. 5, a continuous stream of an explosive gas mixture from chamber 32 is passed through line 38 as a manifold supply connecting by suitable connector means, such as a collar or sleeve 25, with each of the caps A–E respectively to supply a stream of explosive gas mixture through each tube 19 into each corresponding porous ignition charge 17A–E. Instead of the series type purging and charging action of FIG. 4, the explosive gas mixture from each porous ignition charge 17 is discharged therefrom through the conduit, or opening, 26 in a side wall of each cap assembly. As in FIG. 4, after the requisite purging and charging period, the explosive gas mixture in line 38 is ignited by action of spark generation means in chamber 32. The explosive reaction wave front then travels along line 38 through each tube 19, to, in each instance, emplace the resulting explosive energy in initiating contact with the ignition charge.

Figure 6:
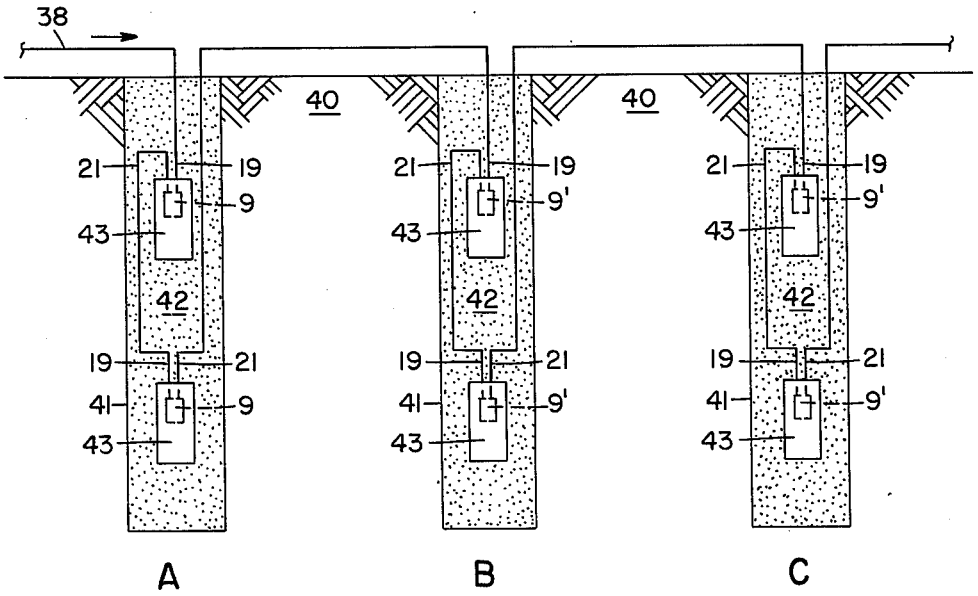
FIG. 6 illustrates an embodiment of the blasting system of the invention including a plurality of blasting caps of either or both of FIGS. 1 and 2 supported for detonation of a series of separate main explosive charges. Like parts in the drawings are designated by like numbers.

Referring to FIG. 6, each of the separate bore holes 41, in earth formation 40, of FIGS. 6A–C is loaded with any suitable cap-insensitive main explosive charge 42 such as an aqueous gel type explosive, prills/fuel oil, or the like. A pair of suitable boosters 43 is embedded in each of the main explosive masses. Each booster is cap-sensitive and is in detonating relationship with main explosive charge 42 adjacent thereto, and is initiated by action of a blasting cap system of the invention such as that of FIG. 4.

Thus in each bore hole 41 of FIG. 6, two booster units 43, e.g., each 500 grams of PETN, tetryl or the like, are embedded and spaced apart, in main explosive charge 42 to provide for detonation of the main explosive charge 42 along its entire length. Each booster unit 43 contains a blasting cap 9 or 9' of FIGS. 1 or 2, respectively. The explosive gas mixture from chamber 32 (not shown) is supplied via line 38 and passed in series through the entire plurality of blasting caps 9 and/or 9' in the separate booster charges in the three bore holes via tubes 19 and 21 of each blasting cap, as illustrated with reference to FIG. 4. The flow of explosive gas mixture from line 38 in series through the entire plurality of blasting caps in the bore holes 41A–C is continued until each porous ignition charge 17 is substantially free from initially present gas, after which the flow of the explosive gas mixture stream is terminated or continued as desired, followed by ignition of the gas in chamber 32 and travel of the explosive reaction wave front in series through each of the blasting caps in initiation relationship with the main explosive charge therein. Dependent on whether a main charge is reliably cap-sensitive, a booster charge(s) may not be required, in which event one or more of the blasting caps are embedded directly in the main charge, and are charged with gas and initiated.

The system of FIG. 6 containing delay caps regulates the burning time of each delay charge and hence, the delay between shots in each bore hole including, when desired, a progressively longer delay time along the entire series of boosters in the bore holes of FIG. 6.

Although the invention is specifically illustrated with reference to delay and nondelay type blasting caps utilizing a porous ignition charge in combination with primer and base charges, with or without an intermediate delay charge, it is to be understood that the invention is applicable to initiation devices in which the ignition charge is the only charge in the device, or is utilized with one or more additional charges, exemplary of which initiating devices are those of the deflagrating or squib type.

A non-electric blasting cap 9 containing a porous ignition charge, as shown in FIG. 1, is made by initially providing elongated cup-shaped shell 10 which is integrally closed at bottom end 11. Base explosive charge 14 and primer charge 16 are placed in the shell 10, with base explosive charge 14 in contact with the inner surface of bottom end 11 and primer charge 16 resting thereon. Where a delay type, non-electric blasting cap with porous ignition charge is desired, as shown in FIG. 2, the delay charge or fuse assembly 22 is placed in shell 10 upon and in contact with primer charge 16. The porous ignition charge 17 may be prepared by initially forming a suitable ignition powder into a pellet, i.e., by pressing the powder within a cylindrical press mold, with sufficient pressure to consolidate the ignition powder. The compressed pellet is then removed from the press mold and cut into small fragments. These fragments are then screened to provide a predetermined size range, free of fine particles and dust, preferably with a maximum cross-sectional dimension less than about 0.187 inch, for flow of a fluid therethrough. The fragments are then placed in shell 10, thereby having a portion thereof in direct contact with primer charge 16 or delay charge 22, if present. The charge fragments are placed in shell 10 to a predetermined height, after which, ignition plug end closure 13, containing tubes 19 and 21, is forced into shell 10 through end 12 until contact is made by face 13' of plug 13 with face 18 of porous ignition charge 17. A standardized fluid flow test is then made on each cap to detect any leakage or blockage of the passageways within the cap.

EXAMPLE

Six non-electric blasting caps containing porous ignition charges were made in accordance with the method of this invention. These six blasting caps were of the delay type containing a base charge, primer charge, delay charge and porous ignition charge as shown in FIG. 2. Each cap was made with a cylindrical aluminum shell having a length of 2.01 in., an I.D. of from 0.249 in. to 0.256 in. and an O.D. of 0.288 in. A base charge 14, which consisted of PETN weighing 0.4 gm., was placed through end 12 into shell 10 in contact with the inner face of bottom end 11. The PETN was placed in the shell as a loose powder and then pressed in the shell. The primer charge 16 consisted of a cylindrical pellet of diazodinitrophenol, weighing 0.29 gm., and was placed through end 12 onto and in contact with base charge 14. The combined height of base charge 14 and primer charge 16 was approximately 0.9 in. The delay charge 22 consisted of a 2 gm. pressed cylindrical pellet of, (weight basis), lead, 46.9%, tin, 8.3%, selenium, 11.6%, lead oxide, 32.2%, and boron, 1.0%, having a length of 0.4 in. This pellet, designed to provide a delay time of 300–400 milliseconds, was placed through end 12 into cap 10 upon and in contact with primer charge 16, to provide a combined base, primer, and delay charge height of 1.3 inches. The porous ignition charge 17 was prepared from an ignition powder consisting of (weight basis) lead, 68.4%, selenium, 26.6%, potassium perchlorate, 2.2%, aluminum, 1.1%, and snow floss, 1.7%. The ignition powder was formed into a 0.250 in. O.D. 0.25 in. pellet by placing the powder into a cylindrical mold and subjecting said powder to a pressure of 3000 p.s.i. The pellet was then cut with a razor blade into small irregular fragments. The desired size range was obtained by retrieving the fragments which passed through a #4 sieve (U.S.S.S.) and were retained on a #8 sieve (U.S.S.S.). The fragments were then loosely placed in shell 10 to a total column height of approximately 1.8 in. for each cap. The closure plug assembly 13, which was 0.45 in. long, was then forced into shell 10 until contact was made by inner face 13' of plug assembly 13 with outer face 18 of porous ignition charge 17. Closure plug assembly 13 contained two 12 in. long tubes 19 and 21 made of low density polyethylene and having an 0.103 in. O.D. and 0.060 in. I.D., which were bonded to plug assembly 13 and had terminal ends 19', within the passageways of plug assembly 13, which were in contact with porous ignition charge 17. The plug assembly 13 was then affixed to the shell 10 by crimping shell 10 around its exterior along the portion adjacent to plug assembly 13.

A test for circuit continuity was then separately performed on each of the six caps by passing nitrogen gas at 50 p.s.i.g. through tube 19, and measuring the exit flow from tube 21.

A stream of gas, comprising, on a volume basis, 50% methane and 50% hydrogen, at an approximate rate of 25 liters (S.T.P.) per minute at 40 p.s.i.g., was mixed with a separate stream of oxygen at a rate of 59 liters (S.T.P.) per minute at 40 p.s.i.g. through 10 feet of 0.25 in. O.D. by 0.120 in. I.D. polyethylene tubing to form an explosive gas mixture as the combined stream. The oxygen constituted approximately 71% of the combined stream, which was passed through each individual cap for approximately 0.25 minute to purge and charge the tubing circuit, including porous ignition charge 17, thereby replacing the air which originally filled the tubing circuit, with the explosive gas mixture. After charging, the resulting explosive gas mixture was in each instance ignited upstream from the individual caps by a spark, whereupon the explosive energy associated with the detonation front, which passed through tube 19 and into porous ignition charge 17, initiated each ignition charge. Each of the six caps fired successfully.

As will be evident to those skilled in the art, various modifications can be made in the light of the foregoing disclosure and discussion, without departing from the spirit or scope of the disclosure or from the scope of the claims.

What I claim and desire to protect by Letters Patent is:

1. A non-electrically initiated blasting cap comprising:

a closed shell, including a plug closure therefor;

an ignition charge in said shell substantially contiguous with said plug closure and initiatable in response to action of explosive energy of an explosive gas mixture, and sufficiently porous and permeable for flow of a gas stream through the interstices thereof;

a first conduit means extending from outside said shell through said plug closure and opening into continguous contact with said ignition charge so as to convey an explosive gas mixture as a confined stream into ignition position in said interstices for responsive initiation of said ignition charge; and a second conduit means extending from contiguous contact with said ignition charge to the outside of the said shell, whereby a stream of said explosive gas can be continuously passed from said first conduit means through the interstices of said ignition charge and through said second conduit means to purge and charge said porous ignition charge and thereafter explosive gas in said first conduit means can be ignited for propagation of resulting explosive energy within the interstices of said porous ignition charge for ignition of same.

2. A blasting cap of claim 1, base, primer and said ignition charges, with or without a delay charge intermediate said primer and ignition charges, contiguously extending in that order toward said plug closure.

3. In a blasting cap of claim 2, said second conduit means comprising a passageway in a side wall of said shell.

4. In a blasting cap of claim 2, said second conduit means extending through said plug closure.

5. The blasting cap of claim 1 wherein said ignition charge as an effective cross-sectional area for gas flow at least substantially equal to the cross-sectional area of said first or second conduit means.

6. The blasting cap of claim 1 wherein said ignition charge is a pellet of agglomerated ignition powder particles, comprising, by weight, about 68.4% lead, 26.6% selenium, 2.2% potassium perchlorate, 1.1% aluminum and 1.7% snow floss.

7. The blasting cap of claim 1 wherein said ignition charge is a cohesive agglomerate of individual particles having a multiplicity of interstitial passageways therethrough.

8. The blasting cap of claim 1, wherein said shell is elongated and said first conduit means comprises a tube extending from outside said shell through said plug closure member in substantial closing contact with said ignition charge.

9. The blasting cap of claim 1, wherein said second conduit means is in a side wall of said shell adjacent to said ignition charge.

10. The blasting cap of claim 8, wherein said second conduit means comprises an additional tube extending through said plug closure in substantial closing contact with said ignition charge.

11. A detonator system for detonation of one or more main charges comprising:

a plurality of spaced apart non-electrically initiated blasting caps, each cap having;
- a closed shell,
- a base charge in the closed end of said shell,
- a primer charge in direct communication with said base charge,
- an ignition charge in substantial contact with said primer charge,
- a plug closure member closing the other end of said shell having an end thereof substantially filling the cross-section of said shell and abutting against said ignition charge, said plug having a first and a second passageway therethrough to allow gas to be introduced into and to exit from said ignition charge,
- said ignition charge substantially filling the the cross-section of said shell between said primer charge and said plug closure member, said ignition charge being sufficiently porous and permeable for flow of a gas stream through the interstices thereof and being initiatable in response to action of explosive energy of said explosive gas mixture, wherein said primer charge is detonatable in response to the initiation of said ignition charge;

an explosive gas mixture;

means for introducing an explosive gas mixture into said plurality of blasting caps;

means for igniting said explosive gas mixture;

wherein said first passageway of the first of said plurality of blasting caps is connected to means for introducing and means for igniting said explosive gas mixture, said second passageway of the first of said plurality is connected to said first passageway of the second of said plurality and each of said first passageways of the remaining plurality of blasting caps being connected to said second passageway of the preceding blasting cap to first allow said explosive gas mixture to flow through each of said interconnected blasting caps in said plurality to purge and charge with said explosive gas mixture said blasting caps and to allow an explosive reaction wave front in response to ignition of said explosive gas mixture to propagate sequentially through each of said blasting caps in said plurality.

12. A detonator system for detonation of one or more main charges comprising:

a plurality of spaced apart non-electrically initiated blasting caps, each cap having,
- a cup-shaped shell,
- a base charge in the closed end of said shell,
- a primer charge in direct communication with said base charge,
- a delay charge in direct communication with said primer charge,
- an ignition charge in substantial contact with said delay charge,
- a plug closure member closing the other end of said shell having an end thereof substantially filling the cross-section of said shell and abutting against said ignition charge, said plug having a first and a second passageway therethrough, to allow gas to be introduced into and to exit from said ignition charge,
- said ignition charge substantially filling the cross-section of said shell between said delay charge and said plug closure member, said ignition charge being sufficiently porous and permeable for flow of a gas stream through the interstices thereof and being initiatable in response to action of explosive energy of an explosive gas mixture, wherein said delay charge is detonatable in response to the initiation of said ignition charge;

an explosive gas mixture;

means for introducing said explosive gas mixture into said plurality of blasting caps;

means for igniting said explosive gas mixture;

wherein said first passageway of the first of said plurality of blasting caps is connected to means for introducing and meand for igniting said explosive gas mixture, said second passageway of the first of said plurality is connected to said first passageway of the second of said plurality and each of said first passageways of the remaining plurality of blasting caps being connected to said second passageway of the preceding blasting cap to first allow said explosive gas mixture to flow through each of said interconnected blasting caps in said plurality to purge and charge with said explosive gas mixture said blasting caps and to allow an explosive reaction wave front in response to ignition of said explosive gas mixture to propagate sequentially through each of said blasting caps in said plurality.

13. In a detonator system of claim 11, each said blasting cap having an elongated shell and said first passageway comprising a tube extending from outside said shell through said plug closure member in substantial closing contact with said ignition charge.

14. In a detonator system of claim 12, each said blasting cap having an elongated shell and said first passageway comprising a tube extending from outside said shell through said plug closure member in substantial closing contact with said ignition charge.

15. In a detonator system of claim 13, each said blasting cap having as a second passageway a second tube extending through said plug closure member.

16. In a detonator system of claim 14, each said blasting cap having as said second passageway a second tube extending through said plug closure member.

17. A detonator system of claim 15 in detonating relationship with at least one main explosive charge.

18. A detonator system of claim 16 in detonating relationship with at least one main explosive charge.

19. A method for initiating a non-electric blasting cap for the initiation of a main explosive charge, wherein said blasting cap contains an ignition charge initiatable in response to action of explosive energy of an explosive gas mixture, said method comprising passing an explosive gas mixture into said blasting cap and directly into the interstices of an ignition charge previous to flow of gas therethrough for ignition and responsive initiation of said ignition charge and then from said interstices to the outside of said blasting cap to purge said ignition charge of gases other than said explosive gas, thereafter retaining said explosive gas as a confined stream along the path of said purge and igniting same upstream from said blasting cap, and propagating resulting explosive energy along said path into ignition relationship with said ignition charge.

* * * * *

UNITED STATES PATENT AND TRADEMARK OFFICE

CERTIFICATE OF CORRECTION

PATENT NO. : U.S.P. 4,073,235
DATED : February 14, 1978
INVENTOR(S) : Robert B. Hopler It is certified that error appears in the above-identified patent and that said Letters Patent are hereby corrected as shown below:

Column 1, line 13;

"employing" should be --emplacing--

Column 1, line 21;

"object" should be --aspect--

Column 2, line 11;

"preparation" should be --propagation--

Claim 12, line 49;

"meand" should read --means-- .

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*